United States Patent [19]

Kawahara et al.

[11] Patent Number: 4,478,134

[45] Date of Patent: Oct. 23, 1984

[54] SWASH PLATE TYPE HYDRAULIC DEVICE

[75] Inventors: Eiichiro Kawahara, Tokorozawa; Koichi Ikeda, Fujimi, both of Japan

[73] Assignee: Honda Giken Kogyo Kabushiki Kaisha, Tokyo, Japan

[21] Appl. No.: 317,310

[22] Filed: Nov. 2, 1981

[30] Foreign Application Priority Data

Oct. 31, 1980 [JP] Japan ..... 55-153014

[51] Int. Cl.[3] ..... F01B 13/04

[52] U.S. Cl. ..... 91/488; 91/499

[58] Field of Search ..... 91/488, 499, 505, 506, 91/507; 417/269

[56] References Cited

U.S. PATENT DOCUMENTS

| | | | |
|---|---|---|---|
| 3,151,528 | 10/1964 | Eastman | 91/507 |
| 3,237,570 | 3/1966 | Schott | 91/488 |
| 3,277,835 | 10/1966 | Wahlmark | 91/507 X |
| 3,366,072 | 1/1968 | Baits et al. | 91/506 |
| 3,373,696 | 3/1968 | Geyer | 91/499 |
| 3,382,793 | 5/1968 | Gantzer | 91/499 |
| 3,396,670 | 8/1968 | Baits | 91/506 |
| 3,481,277 | 12/1969 | Pettibone | 91/507 |
| 3,678,807 | 7/1972 | Papst | 91/499 X |

FOREIGN PATENT DOCUMENTS

| | | | |
|---|---|---|---|
| 1127830 | 4/1962 | Fed. Rep. of Germany | 91/507 |
| 55-91776 | 7/1980 | Japan | 91/499 |
| 587902 | 5/1947 | United Kingdom | 91/507 |

*Primary Examiner*—William L. Freeh
*Assistant Examiner*—Paul F. Neils
*Attorney, Agent, or Firm*—Armstrong, Nikaido, Marmelstein & Kubovcik

[57] ABSTRACT

A swash plate type hydraulic device comprising a rotary shaft rotatably supported on a frame, a cylinder block mounted on the rotary shaft for rotation therewith, a plurality of cylinder bores formed in the cylinder block in a circular pattern around the axis of rotation thereof, a plurality of plungers slidably fitted in the cylinder bores so as to define hydraulic chambers, a swash plate mounted on the frame in an inclined manner with respect to the rotary shaft in opposing relation to the plungers, an annular shoe being in abutting engagement with the swash plate for relative rotation, a plurality of connecting rods operatively connecting the shoe and plungers, and a pair of synchronous gears respectively mounted on the cylinder block and shoe in meshing engagement with each other for synchronized rotation of the cylinder block and shoe. The connecting rods are universally jointed at one end thereof to the shoe and at the other end thereof to the plungers.

5 Claims, 4 Drawing Figures

SWASH PLATE TYPE HYDRAULIC DEVICE

BACKGROUND OF THE INVENTION

1. Field of the Invention

This invention relates to a hydraulic device, such as a swash plate type hydraulic pump and a swash plate type hydraulic motor.

2. Description of the Prior Art

There is a known hydraulic device of this kind, which comprises a cylinder block fixedly mounted on a rotary shaft rotatably supported on a frame, a plurality of plungers slidably fitted in the cylinder block and arranged circularly around and concentrically with the axis of rotation thereof, a swash plate mounted on the frame in an inclined manner with respect to the rotary shaft in opposing relation to the plungers, the plungers being in abutting engagement with the inclined surface of the swash plate through universally rotatable shoes such that the plungers are moved reciprocatingly along the surface of the swash plate by the rotation of the cylinder block, or alternatively the cylinder block is rotated by the reciprocating movements of the plungers along the surface of the swash plate. The shoes in this hydraulic device, which are moved slidingly on the inclined surface of the swash plate, contribute to the smooth movements of the plungers along the surface of the swash plate.

In the conventional hydraulic device of this kind, the shoes are provided separately for the respective plungers and are adapted to move in the radial direction in accordance with an angle of inclination of the swash plate. Therefore, the shoes are sometimes caused to float from the slide surface of the swash plate or vibrate due to the fluctuations of hydraulic pressure in the interior of the cylinder block. The floatation and vibration of the shoes cause wear on various component parts of the device, noises and a decrease in the operation efficiency. To avoid these problems, it is known to provide a holding plate on the rear surfaces of all of the shoes. However, it is very difficult to manufacture such a holding plate with high tolerance that can be securely placed uniformly into abutting engagement with the rear surfaces of all of the shoes. Accordingly, no satisfactory results can be obtained.

SUMMARY OF THE INVENTION

An object of the present invention is to provide a hydraulic device of the character as described above which is capable of effectively preventing the floating up and/or vibrations of shoes as well as the plungers from being subjected to side thrust.

To achieve this object, the present invention proposes a swash plate type hydraulic device which comprises a frame, a rotary shaft rotatably supported on said frame, a cylinder block mounted on said rotary shaft for rotation therewith, a plurality of cylinder bores formed in said cylinder block and arranged in a circular pattern around the axis of rotation of said cylinder block, a plurality of plungers slidably fitted in said cylinder bores for reciprocating movement so as to define therein hydraulic chambers, a swash plate mounted on said frame in an inclined manner with respect to said rotary shaft in opposing relation to said plungers, an annular shoe being in abutting engagement with said swash plate for relative rotation, a plurality of connecting rods operatively connecting said shoe and said plungers, and a pair of synchronous gears respectively mounted on said cylinder block and said shoe in meshing engagement with each other for synchronized rotation of said block and said shoe.

The above and other objects as well as advantageous features of the invention will become apparent from the following description of the preferred embodiment taken in conjunction with the accompanying drawings.

DESCRIPTION OF THE PREFERRED EMBODIMENT

Figure 1:
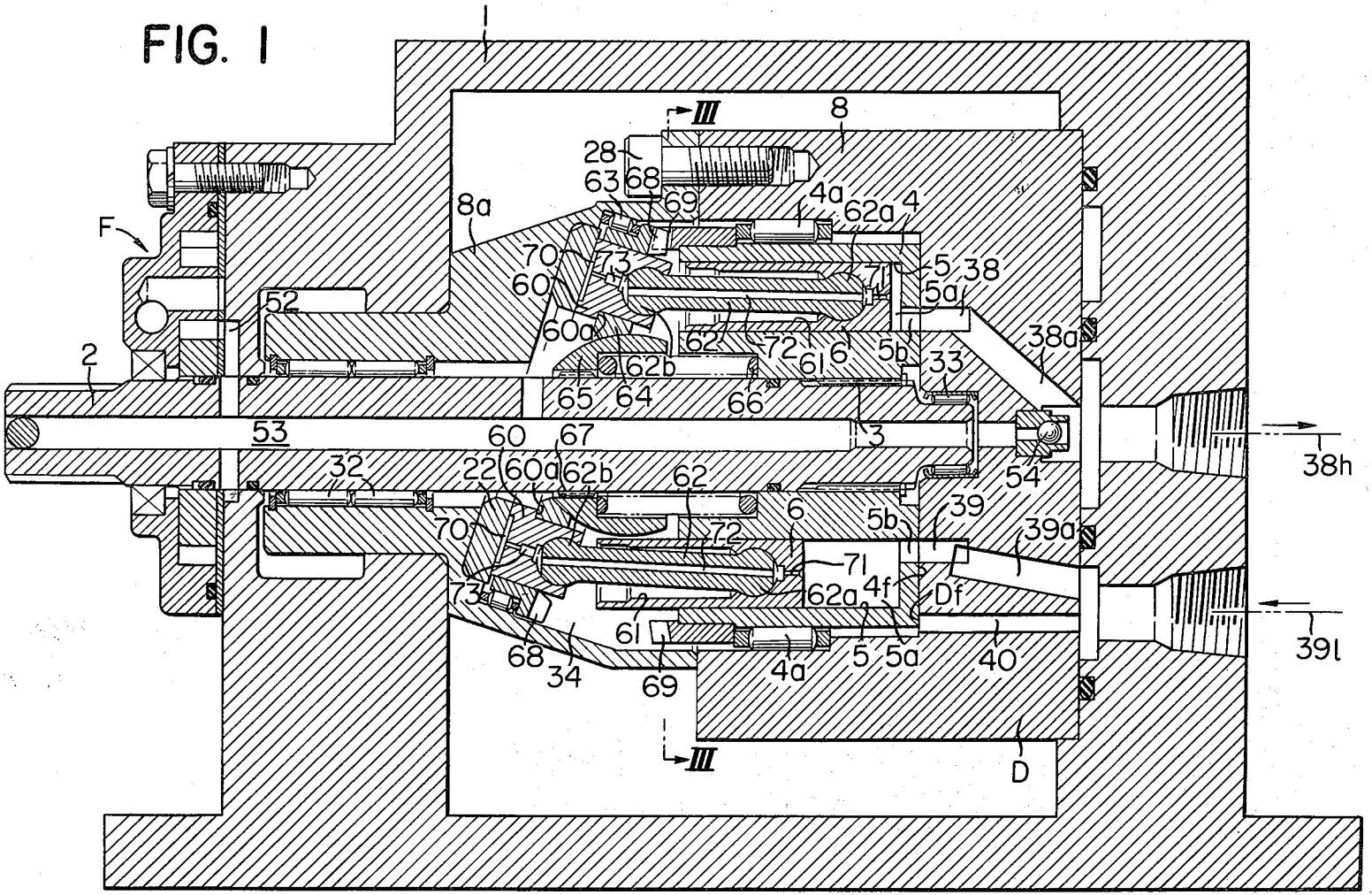
FIG. 1 is a side elevational view in longitudinal section of an embodiment of a swash plate type hydraulic device according to the present invention.
Figure 2:
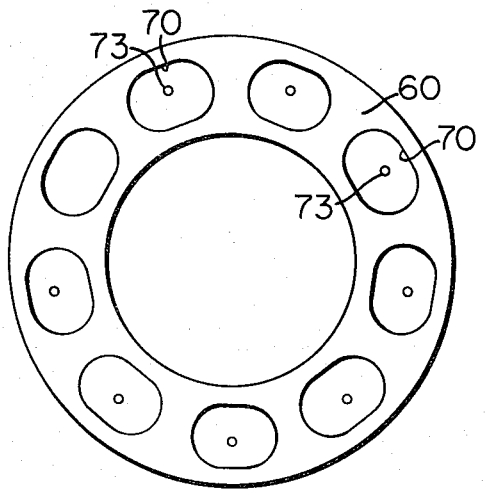
FIG. 2 is a plan view of a shoe shown in FIG. 1.
Figure 3:
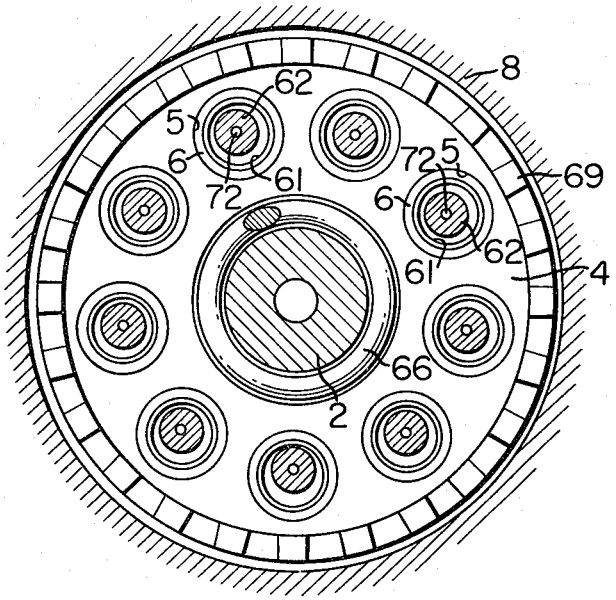
FIG. 3 is a sectional view taken along the line III—III in FIG. 1.

An embodiment of the present invention applied to a hydraulic pump will be described with reference to the accompanying drawings. Referring to FIG. 1, a rotary shaft 2 is rotatably supported on a fixed machine frame 1 via bearings 32, and a cylinder block or a pump cylinder 4 is spline-connected at 3 to the rotary shaft 2 in such a manner that the cylinder block 4 can be moved slidingly at the central portion thereof in the axial direction. A swash plate 22 and a distribution board D are provided on the left side and right side, respectively, of the cylinder block 4.

The distribution board D is integrally provided at the circumferential portion thereof with a cylindrical housing 8, which accommodates the cylinder block 4 therein. The cylinder block 4 is supported rotatably on the housing 8 via the bearings 4*a*. The distribution board D supports at the central portion thereof via needle bearings 33 an end portion of the rotary shaft or input shaft 2 extended through the cylinder block 4. In order to bring opposed surfaces Df, 4*f* of the distribution board D and cylinder block 4 into close contact with each other, springs 66 are provided, which allow the cylinder block 4 to be urged against the distribution board D.

The swash plate 22 is fitted into a cup-shaped swash plate holder 8*a* surrounding the rotary shaft 2 and kept inclined at a predetermined angle with respect to the rotary shaft 2.

The housing 8 and swash plate holder 8*a* are joined together with bolts 28 to define an oil chamber 34 therein. The housing 8 and swash plate holder 8*a* are secured to the machine frame 1 by suitable fixing means.

The cylinder block 4 is provided therein with a plurality of cylinder bores 5, 5 . . . (nine cylinder bores in the drawings), which are arranged circularly around the axis of rotation of the cylinder block 4 at equal distances with respect to each other and extend parallel to the rotational axis, and the same number of plungers 6, 6 . . . are fitted slidably in the cylinder bores 5, 5 . . .

Each plunger 6 defines a pump chamber 5*a* in the relative cylinder bore 5, and a pump port 5*b* communicated with the pump chamber 5*a* is opened in the front surface 4*f* of the cylinder block 4. The pump ports 5*b*, 5*b* . . . of all of the pump chambers 5*a*, 5*a* are positioned on the same circle having as the center thereof the axis of rotation of the cylinder block 4.

On the other hand, the distribution board D is provided in a half of the end surface Df thereof with an arcuate suction bore 39 capable of being communicated with each pump port 5*b*, and in the other half thereof with an arcuate discharge bore 38 also capable of being communicated with each pump port 5*b*. Suction and discharge ports 39*a*, 38*a* communicated separately with the suction and discharge bores 39, 38 are opened in the outer end surface of the distribution board D. A conduit 39*l* joined to a low pressure portion of a hydraulic motor (not shown) is communicated with the suction port 39*a*, while a conduit 38*h* joined to a high pressure portion of the above-mentioned hydraulic motor is communicated with the discharge port 38*a*.

Each plunger 6 has a cylindrical bottomed bore 61 opened in the outer end surface thereof, i.e. that end surface thereof which is on the side of the swash plate 22. A connecting rod 62 is inserted in the bore 61 and connected via a ball joint 62*a* provided at the inner end thereof to the plunger 6 in an universally rotatable manner. The connecting rod 62 is projected long to the outside of the bottomed bore 61 and also connected via a ball joint 62*b* provided at the outer end thereof, to an annular, integrally-formed shoe 60, which is supported slidably on the inclined surface of the swash plate 22, in such a manner that the connecting rod 62 can be rotated universally with respect to the annular shoe 60.

A plurality of hydraulic pockets 70, 70 . . . are provided in that slide surface of the shoe 60 which is opposed to the swash plate 22 (hydraulic pockets 70, 70 . . . , the number of which is the same as that of the plungers 6, 6 . . . , are provided preferably in alignment with the plungers as shown in the drawings). In order to communicate the pump chambers 5*a*, 5*a* . . . with these hydraulic pockets 70, 70 . . . , oil bores 71, 72, 73, which are communicated with each other, are formed in each plunger 6, each connecting rod 62, and the shoe 60, respectively.

The annular shoe 60 is supported at the outer circumferential surface thereof on the swash plate holder 8*a* via bearings 63. A holding ring 64 engaged with an inner circumferential stepped portion 60*a* of the rear surface of the shoe 60 receives the resilient forces of the above-mentioned springs 66 via a spring retainer 65 to allow the shoe 60 to be urged against the swash plate 22. The shoe 60 is thereby rotated constantly in a predetermined position to move slidingly on the swash plate 22. The spring retainer 65 is slidably spline-connected to the rotary shaft 2, and contacts the holding ring 64 at a spherical surface thereof. Accordingly, the spring retainer 65 contacts the holding ring 64 uniformly irrespective of its fixing position to allow the resilient force of the springs 66 to be transmitted to the holding ring 64.

Bevel gears 69, 68, which are engageable with each other, are secured to opposed end portions of the cylinder block 4 and shoe 60, respectively. These bevel gears 69, 68 consist of synchronous gears having the same number of teeth.

A known gear type supplementary pump F operated by the rotary shaft 2 is provided at one side of the machine frame 1. A feed port 52 of this pump F is communicated with the oil chamber 34 mentioned in the previous paragraph, via an oil passage 53 in the rotary shaft 53. The oil chamber 34 is communicated with the suction port 39*a* of the distribution board D via an oil passage 40. The oil passage 53 is communicated with the discharge port 38*a* of the distribution board D via a check valve 54. Therefore, an oil can be supplied from the supplementary pump F to the oil chamber 34, suction port 39*a* and discharge port 38*a* in accordance with a pressure decrease in each thereof.

The operation of this embodiment will now be described. When the rotary shaft 2 is driven by a motor (not shown) to rotate the cylinder block 4, the shoe 60 is thereby synchronously rotated via the synchronous gears, i.e. the bevel gears 69, 68. As the cylinder block 4 and shoe 60 are thus rotated, a plunger 6 moving on the downward portion of the inclined surface of the swash plate 22 makes an exhaust stroke for increasing the pressure in the pump chamber 5*a* with a pressure applied from the swash plate 22 thereto via the shoe 60 and connecting rod 62, while a plunger 6 moving on the upward portion of the same inclined surface makes a suction stroke for vacuuming a pump chamber 5*a*. In the suction stroke, the pump port 5*b* is communicated with the suction bore 39, and the working oil in the low pressure portion of the hydraulic motor communicated with the suction port 39*a* is sucked into the pump chamber 5*a*. In the exhaust stroke, the pump port 5*b* is communicated with the discharge bore 38, and the pressure oil, the pressure of which is increased in the pump chamber 5*a*, is supplied from the discharge port 38*a* to the high pressure portion of the hydraulic motor.

In the above-described operation, the loci of rotations of the centers of the ball joints 62*a*, 62*b* at both ends of a connecting rod 62 are not included in the same cylindrical surface due to the inclination of the shoe 60. Accordingly, the connecting rod 62 is oscillated slightly around the ball joint 62*a* serving as a fulcrum, within the bottomed bore 61 in the plunger 6 in accordance with the difference between the loci of rotations of the centers of the ball joints 62*a*, 62*b*. The reciprocating motion of the connecting rod 62 is not restricted at all by the plunger 6.

The pressure oil generated in the pump chamber 5*a* is supplied to the hydraulic pocket 70 in the shoe 60 via the oil bores 71, 72, 73, and the pressure of this oil works in the direction in which the shoe 60 is moved away from the swash plate 22. Consequently, a part of the impellent force applied from the plunger 6 to the shoe 60 is offset to reduce the contact pressure between the shoe and swash plate 22 and lubricate at once the slide surfaces of the shoe 60 and swash plate 22. Thus, the shoe 60 can be rotated smoothly as it is in contact with the swash plate 22.

Substantially a half of the plungers 6 are always in an exhaust stroke and press a half of the annular shoe 60 against the swash plate 22 via the connecting rods 62 with the high hydraulic pressure in the pump chamber 5*a*. The pressure with which a half of the shoe 60 is pressed against the swash plate 22 is also applied to the other half thereof. Therefore, the shoe 60 is always pressed at the whole of the slide surface thereof against the swash plate 22. Accordingly, even when a sudden decrease in pressure occurs by any reason in the pump chamber opposed to the plungers 6 in a suction stroke, even a part of the shoe 60 is not floated from the swash plate 22.

The above embodiment can, of course, be used as a hydraulic motor. It is in this case a matter of course that a high hydraulic pressure source and a low hydraulic pressure source are connected to the ports 39*a*, 38*a*, respectively, and that the rotary shaft 2 is used as an output shaft.

Figure 4:
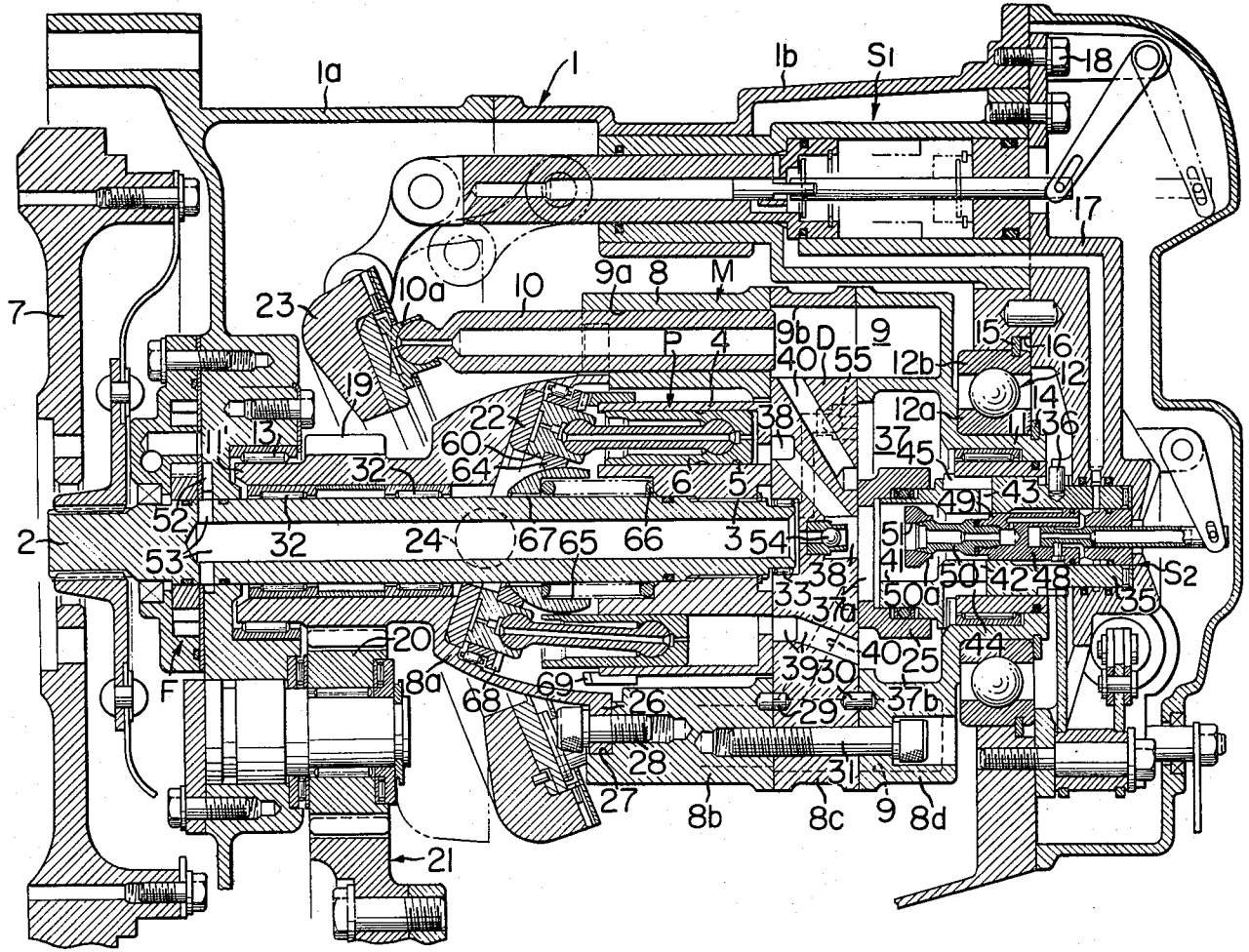
FIG. 4 is a side elevational view in longitudinal section of a stepless hydraulic transmission provided with the swash plate type hydraulic device shown in FIG. 1.

FIG. 4 shows a stepless hydraulic transmission employing the hydraulic pump of the invention as described above. Reference numeral 1 denotes a transmission case consisting of a combination of complementary case members 1*a*, 1*b*, in which a transmission consisting of a hydraulic pump P and a hydraulic motor M is set.

The construction of the hydraulic pump P is the same as that of the hydraulic device shown in FIG. 1. Those parts of the hydraulic pump P which are identical with any parts of the hydraulic device shown in FIG. 1 are designated by the same reference numerals used therein.

The hydraulic motor M has a motor cylinder 8 provided concentrically around and adapted to be rotated relatively to a cylinder block or a pump cylinder 4, and a plurality of motor plungers 10, 10 . . . slidably fitted in the same number of cylinder bores 9, 9 . . . arranged circularly in the motor cylinder 8 in such a manner as to surround the center of rotation thereof.

A pair of support shafts 11, 11' are projected from both axial end surfaces of the motor cylinder 8. The support shaft 11 is supported on an end wall of the right case member 1*b* via a ball bearing 12, and the other support shaft 11' on an end wall of the left case member 1*a* via a needle bearing 13. A stopper ring 14 is fitted around the outer end of the support shaft 11 so as to hold an inner race 12*a* of the ball bearing 12 between the stopper ring 14 and the motor cylinder 8. Another stopper ring 15 engaged with an outer end portion of the outer circumferential surface of an outer race 12*b* is fitted in an annular recess 16 formed in the outer surface of the end wall of the right case member 1*b*. A holding plate 17 contacting the outer end of the outer race 12*b* is fixed detachably to the right case member 1*b* with bolts 18. Thus, the ball bearing 12 and support shaft 11 can be prevented from being moved axially with respect to the right case member 1*b*.

The other support shaft 11' having a gear 19 formed integrally therewith is used as an output shaft, and an output from the hydraulic motor M is extracted from the gear 19 so as to be transmitted to a differential gear 21 via an intermediate gear 20.

A motor swash plate 23 opposed to each of the motor plungers 10 is supported tiltably on the transmission case 1 via a pair of trunnions 24 projected from the outer ends thereof. A motor shoe 10*a* slidingly contacting an inclined surface of the motor swash plate 23 is provided on each of the motor plungers 10 so as to rotate universally with respect to the latter. Thus, the motor swash plate 23 makes the motor plungers 10 move reciprocatingly in accordance with the rotation of the motor cylinder 8 to allow the plungers 10 to repeat their expansion and compression strokes. During the above operation, the stroke of the motor plungers 10 can be regulated in a non-stepped manner between zero and a maximum level by tilting the motor swash plate 23 between a position in which the motor swash plate 23 is perpendicular to the motor plungers 10 and a position as shown in the drawing where the motor swash plate 23 is inclined at a maximum angle.

Between the hydraulic pump P and hydraulic motor M, a closed hydraulic circuit is formed via a distribution board D and a distribution ring 25, which will be described later. When the pump cylinder 4 is rotated via the input shaft 2, a high pressure working oil discharged from a cylinder bore 5 holding a pump plunger 6 in an exhaust stroke is supplied into a cylinder bore 9 holding a motor plunger 10 in an explansion stroke. In the meantime, the working oil discharged from a cylinder bore 9 holding a motor plunger 10 in a compression stroke returns to a cylinder bore 5 holding a pump plunger 6 in a suction stroke. During the above operation, the motor cylinder 8 is rotated by the sum of a reaction torque applied from the pump plunger 6 in an exhaust stroke thereto via the pump swash plate 22, and a reaction torque received by the motor plunger 10 in an expansion stroke from the motor swash plate 23.

In this case, a change gear ratio of the motor cylinder 8 with respect to the pump cylinder 4 is determined by the following equation.

$$\text{Change gear ratio} = \frac{\text{Number of revolutions per minute of pump cylinder 4}}{\text{Number of revolutions per minute of motor cylinder 8}} = 1 + \frac{\text{Capacity of hydraulic motor } M}{\text{Capacity of hydraulic pump } P}$$

As is apparent from the above equation, a change gear ratio can be changed from one to a desired level by changing a capacity of the hydraulic motor M from zero to a desired level. Since the capacity of the hydraulic motor M is determined by the stroke of the motor plungers 10, a change gear ratio can be regulated in a steppless manner from one to a certain level by tilting the motor swash plate 23 from its position perpendicular to the motor plungers 10 to a position in which it is inclined at a certain angle. A hydraulic servomotor $S_1$ for use in tilting the motor swash plate 23 is provided on the transmission case 1.

The motor cylinder 8 consists of axially-divided first to fourth portions 8*a*–8*d*. The support shaft 11' and pump swash plate 22 are provided on the first portion 8*a*. A bearing bore 9*a* adapted to guide the motor plungers in sliding motion, and constituting a part of the cylinder bore 9 is provided in the second portion 8*b*. An oil chamber 9*b* of a diameter slightly greater than that of the bearing bore 9*a*, which oil chamber continuously extends from the latter and constitutes another part of the cylinder bore 9, is provided in the third and fourth portions 8*c*, 8*d*. The third portion 8*c* constitutes the distribution board D.

The first portion 8*a* has a connecting flange 26 formed integrally therewith at that end portion thereof which is opposed to the second portion 8*b*. The flange 26 is closely fitted in a positioning recess 27 provided in that end surface of the second portion 8*b* which is opposed thereto, being fastened to the second portion 8*b* with a plurality of bolts 28. The second, third and fourth portions 8*b*, 8*c*, 8*d* are positioned with respect to each other with knock pins inserted into the joint portions thereof, while being combined together with a plurality of bolts 31.

The input shaft 2 is supported at an outer end portion thereof on an intermediate portion of the support shaft 11' via needle bearings 32, and at an inner end portion thereof on the central portion of the distribution board D via a needle bearing 33.

A spring 66 is provided between the pump cylinder 4 and the spring retainer 65 referred above. The pump cylinder 4 is pressed against the distribution board D by the resilient force of the spring 66 to prevent the oil leakage from the rotary sliding portions thereof, and a reaction force of the resilient force of the spring 66 is transmitted to and supported by the motor cylinder 8 via a holding ring 64, a pump shoe 60 and pump swash plate 22.

A fixed shaft 35, which is extended through the support shaft 11 for the motor cylinder 8, is connected to the holding plate 17 via pins 36. The distribution ring 25 contacting the distribution board D is supported eccentrically on the inner end of the fixed shaft 35. A hollow 37 in the fourth portion 8*d* of the motor cylinder 8 is divided into an inner chamber 37*a* and an outer chamber 37*b* by the distribution ring 25. The distribution board D is provided with discharge and suction ports 38, 39. A cylinder bore 5 holding a pump plunger 6 in an exhaust stroke is communicated with the inner chamber 37*a* via the discharge port 38, while a cylinder bore 5 holding a pump plunger 6 in a suction stroke is communicated with the outer chamber 37*b* via the suction port 39. The distribution board D is provided with a plurality of communication ports 40, 40 . . . , via which the cylinder bores 9, 9 . . . in the motor cylinder 8 are communicated with the inner chamber 37*a* or outer chamber 37*b*.

When the pump cylinder 4 in the above-described transmission is rotated, a high pressure working oil generated in an exhaust stroke of a pump plunger flows from the discharge port 38 into the inner chamber 37*a*, and further into a cylinder bore 9 holding a motor plunger 10 in an expansion stroke via a communication port 40 communicated with the inner chamber 37*a*, to apply an impellent force to the same plunger 10. In the meantime, the working oil discharged by a motor plunger 10 in a compression stroke returns to a cylinder bore 5 holding a pump plunger in a suction stroke via a communication port 40 communicated with the outer chamber 37*b*, and via the suction port 39. Owing to such circulation of working oil, the transmission of power from the hydraulic pump P to the hydraulic motor M, which is described in the above, is carried out.

The fixed shaft 35 referred to above has a central bore 41, and a plurality of short-circuit ports 42, 43 (two short-circuit ports in the drawing) extended through the side wall thereof. The inner ends of the short-circuit ports 42, 43 are continuous with the inner chamber 37*a* via the central bore 41, and the outer ends of the short-circuit ports 42, 43 with the outer chamber 37 via outer circumferential bores 44, 45 formed in the fixed shaft 35. The short-circuit ports 42, 43 are adapted to be opened and closed in accordance with the rightward and leftward movements of a clutch valve 48 slidably fitted in the central bore 41. When the clutch valve 48 is in a right-hand position in FIG. 4, the short-circuit ports 42, 43 are opened to communicate the inner and outer chambers 37*a*, 37*b* with each other. As a result, the working oil flowing out from the discharge port 38 of the distribution board D immediately enters the suction port 39, so that the supplying of the working oil into the hydraulic motor M is interrupted. Accordingly, the hydraulic transmission is in a so-called clutch-off state, in which the hydraulic motor M is not in operation. When the clutch valve 48 is moved to left to close both of the short-circuit ports 42, 43, the operation for circulating the working oil from the hydraulic pump P to the hydraulic motor M is carried out, so that the hydraulic transmission is in a clutch-on state. When the clutch valve 48 is in an intermediate position, which is halfway between the above-mentioned right-hand and left-hand positions, the circulation of the working oil is carried out in accordance with the opening degrees of the short-circuit ports 42, 43, so that the hydraulic transmission is in a semi-clutch-on state.

A valve rod 50 is screwed to an end of the clutch valve 48, and an umbrella type valve body 51 is connected to a spherical end portion 50*a* thereof in an universally rotatable manner. The valve body 51 can be brought into close contact with the distribution board D so as to close the discharge port 38, when the clutch valve 48 is moved to left in FIG. 4 beyond the position where the clutch valve 48 causes the hydraulic transmission to be put in a clutch-on state. The discharge port 38 is closed with the valve body 51 when the motor swash plate 23 is rotated to its upright position to set a change gear ratio to 1:1. Thus, the pump plungers 6 are hydraulically locked to allow the motor cylinder 8 to be actuated mechanically via the pump cylinder 4, pump plungers 6 and pump swash plate 22. Accordingly, an impellent force applied from the motor plungers 10 to the motor swash plate 23 is lost to reduce the load imposed on each part of the hydraulic transmission.

A hydraulic servomotor $S_2$ is provided on the fixed shaft 35, which is used to operate the sliding movement of the clutch valve 48. A supplementary pump F is provided on the outer side of the left case member 1*a*. The pump F is adapted to be operated by the input shaft 2 to suck an oil from an oil reservoir (not shown) and generate a working oil of a predetermined pressure. A discharge port 52 of the pump F is communicated with an oil passage 53 in the input shaft 2, and further with the discharge port 38 of the distribution board D and the outer chamber 37*b* via check valves 54, 55, respectively. Therefore, when the working oil leaks from the closed hydraulic circuit between the hydraulic pump P and hydraulic motor M, the oil leakage can be compensated automatically by an operation of the supplementary pump F.

According to the present invention described above, an annular shoe is slidably supported on an inclined surface of a swash plate, and a plurality of plungers, which are slidably fitted in a cylinder block, are connected to the shoe via connecting rods with the shoe and the cylinder block operatively connected together via synchronous gears. Accordingly, the shoe as a whole can be pressed against the inclined surface of the swash plate under the action of a high hydraulic pressure applied to some of the plungers so that the floatation and vibration of the shoe can be minimized to reduce wear and damage of the shoe and the swash plate to a substantial extent. Since the shoe is substantially free from vibration and floatation, it does not make noise, nor causes a decrease in the operation efficiency.

Moreover, due to the fact that the connecting rods are connected to the shoe and the plunger for universal rotation, it is possible to effect the most effective power transmission between the swash plate and the plunger without applying any substantial side thrust to the plunger. Thus, the plungers can smoothly slide in the cylinder block at all times without being twisted, thereby reducing their wear and hence the friction loss of power to a great extent.

While the invention has been described with reference to a preferred embodiment thereof, it will be understood by those skilled in the art that various modifications may be made without departing from the spirit and scope of the appended claims.

What is claimed is:

1. A swash plate type hydraulic device comprising a frame; a rotary shaft rotatably supported on said frame; a cylinder block mounted on said rotary shaft for rotation therewith, a plurality of cylinder bores being formed in said cylinder block and arranged in a circular pattern around the axis of rotation of said cylinder block; a plurality of plungers slidably fitted in said cylinder bores for reciprocating movement so as to define therein hydraulic chambers, said hydraulic chambers being selectively placed into communication with a low pressure hydraulic passage when said plunger is in a suction stroke and into communication with a high pressure hydraulic passage when said plunger is in an exhaust stroke; a swash plate mounted on said frame in an inclined manner with respect to said rotary shaft in opposing relation to said plungers; an annular shoe being in abutting engagement with said swash plate for relative rotation, said shoe having a slide surface opposed to said swash plate, said slide surface being formed with a plurality of hydraulic pockets in communication with said hydraulic chambers in said plungers via hydraulic passages;

a plurality of connecting rods operatively connecting said shoe and said plungers, said hydraulic passages which communicate said hydraulic pockets with said hydraulic chambers being formed in and extending through said plungers, said connecting rods and said shoe; and a pair of synchronous gears respectively fixedly secured to said cylinder block and said shoe in meshing engagement with each other for synchronized rotation of said block and said shoe.

2. A swash plate type hydraulic device according to claim 1, wherein each of said connecting rods is connected at one end thereof to said shoe for universal rotation and at the other end thereof to the related plunger for universal rotation.

3. A swash plate type hydraulic device according to claim 1, wherein said cylinder block is splined to said rotary shaft for axial sliding movement.

4. A swash plate type hydraulic device according to claim 3, comprising a spring disposed between said cylinder block and said shoe for urging said cylinder block and said shoe in a direction away from each other.

5. A swash plate type hydraulic device according to claim 4, comprising a spring retainer splined to said rotary shaft for axial sliding movement for receiving one end of said spring, said retainer having a spherical outer surface on which said shoe is supported for universal rotation.

* * * * *